US008245372B2

(12) United States Patent
Haussler et al.

(10) Patent No.: US 8,245,372 B2
(45) Date of Patent: Aug. 21, 2012

(54) NEEDLE FOR A TEXTILE MACHINE

(75) Inventors: Hans Haussler, Oporto (PT); Gustav Wizemann, Messstetten-Hossingen (DE); Christian Gerth, Albstadt (DE); Reinhold Eydner, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 170 days.

(21) Appl. No.: 12/704,640

(22) Filed: Feb. 12, 2010

(65) Prior Publication Data

US 2010/0251525 A1 Oct. 7, 2010

(30) Foreign Application Priority Data

Feb. 12, 2009 (EP) ..... 09152725

(51) Int. Cl.
*D04H 18/00* (2012.01)

(52) U.S. Cl. ..... 28/115

(58) Field of Classification Search ..... 28/107–115; 223/102; 24/48, 706.1, 711.1, 711.4, 706; 112/222, 226

See application file for complete search history.

(56) References Cited

U.S. PATENT DOCUMENTS 321,864 A * 7/1885 Taylor ..... 24/706
375,978 A * 1/1888 Barraclough ..... 24/706.1
712,952 A * 11/1902 McGill ..... 24/711.4
758,289 A * 4/1904 Wittigsohlager ..... 24/710.5
782,830 A * 2/1905 Danoyger ..... 24/711.4
904,751 A * 11/1908 Bernthold ..... 229/78.2
920,249 A * 5/1909 Bishop ..... 24/12
945,412 A * 1/1910 Pettee ..... 24/711.4
1,219,070 A * 3/1917 Bock ..... 24/711.1

(Continued)

FOREIGN PATENT DOCUMENTS

DE 1410492 10/1968

(Continued)

OTHER PUBLICATIONS

W. Reichelt, "Moderne Filznadeln zur Erzeugung marktgerechter Vliesstoffe", Melliand Textilberichte, Deuscher Fachverlag, Frankfurt AM Main, DE, Bd. 73, Nr. 5, 1. May 1, 1992, Seiten 386-390, XP000273203, ISSN: 0341-0781.

(Continued)

*Primary Examiner* — Amy Vanatta
(74) *Attorney, Agent, or Firm* — Fitch, Even, Tabin & Flannery, LLP

(57) ABSTRACT

A needle (15) for a textile machine, in particular, to a felting needle or a fork needle. A working section (17) extends along a longitudinal axis (16) and has a needle point (18). Adjoining the working section (17) are a lower shank section (20) and an upper shank section (25), both being arranged so as to extend coaxially relative to each other along the longitudinal axis (16). Adjoining the upper shank section (25), a needle foot (30) is provided, said needle foot comprising a holding means (32). The holding means (32) extends in a transverse direction (31) and comprises two legs (38, 39), said legs extending from the longitudinal axis (16) and away from each other.

16 Claims, 5 Drawing Sheets

U.S. PATENT DOCUMENTS

| | | | | | |
|---|---|---|---|---|---|
| 1,731,556 | A | * | 10/1929 | Wren et al. | 223/102 |
| 2,017,100 | A | * | 10/1935 | Lang | 223/102 |
| 2,318,235 | A | * | 5/1943 | Lapham | 112/80.05 |
| 2,391,560 | A | * | 12/1945 | Foster | 28/115 |
| 2,548,521 | A | * | 4/1951 | Doyle | 81/488 |
| 2,663,065 | A | * | 12/1953 | Thomas | 28/115 |
| 2,857,650 | A | * | 10/1958 | Lauterbach | 28/115 |
| 2,873,507 | A | * | 2/1959 | Kelson | 28/115 |
| 3,388,443 | A | * | 6/1968 | O'Byrne | 28/115 |
| 3,397,436 | A | * | 8/1968 | Zocher | 28/115 |
| 3,464,097 | A | * | 9/1969 | Zocher | 28/115 |
| 3,680,182 | A | * | 8/1972 | Scott | 28/115 |
| 3,877,120 | A | * | 4/1975 | Okamoto et al. | 28/115 |
| 4,037,297 | A | * | 7/1977 | Foster | 28/115 |
| 4,540,108 | A | * | 9/1985 | Campbell | 223/102 |
| 5,897,935 | A | * | 4/1999 | Ellis et al. | 428/223 |

FOREIGN PATENT DOCUMENTS

| | | |
|---|---|---|
| DE | 6606717 | 11/1970 |
| DE | 2108115 | 2/1971 |
| DE | 3105358 | 9/1982 |

OTHER PUBLICATIONS

Korean Patent Office Action, dated Dec. 22, 2011, issued in Korean appln. 10-2010-0012281.

* cited by examiner

NEEDLE FOR A TEXTILE MACHINE

CROSS-REFERENCE TO RELATED APPLICATION

The present application claims the priority of European Patent Application No. 09 152 725.9, filed Feb. 12, 2009, the subject matter of which, in its entirety, is incorporated herein by reference.

BACKGROUND OF THE INVENTION

The invention relates to a needle for a textile machine, in particular, to a felting needle or fork needle.

Such a needle has been known, for example, from document U.S. Pat. No. 2,857,650 B. In so doing, the needle has a working section, an adjoining shank section, and a needle foot adjoining said shank section. This needle foot comprises a holding means that extends radially away from the longitudinal axis of the needle and away therefrom. For example, the holding means of the needle foot can be shaped during the manufacture of the needle in that a wire blank is being bent.

In the operative position of the needle, said needle is set in a needle holder of a textile machine, for example a felting machine. The upper shank section is accommodated in a bore of the needle board, whereby the holding means of the needle foot is arranged in a groove on the upper side of the needle board. A needle bar of the needle holder is set on the upper side of the needle board and, in so doing, pushes onto the holding means of the needle foot. If the holding means is not bent in an exactly rectangular manner relative to the longitudinal axis, a point-shaped contact or a contact with only a very small contact surfaces is created between the needle bar and the transverse element. As a result of this, the needle bar can be damaged. In addition, the contact site is not in alignment with the longitudinal axis of the needle.

Considering this, the object is to provide an improved needle, whereby, in particular, the contact between the needle bar of the needle holder of a textile machine and the needle is to be optimized.

SUMMARY OF THE INVENTION

The above object is generally achieved according to the present invention by a needle having a working section—i.e., a lower or first shank section as well as an upper or second shank section—that is arranged so as to be coaxial with respect to the longitudinal axis that essentially extends in the direction of movement of the needle. Due to this coaxial arrangement of the three sections, the needle is imparted with sufficient stability, i.e., also during operation at high operating speeds. The second shank section is arranged adjoining the needle foot. The needle foot is configured as a holding means that has two legs. The two legs of the holding means extend away from each other in two opposite directions, starting at the longitudinal axis of the needle. In so doing, the holding means of the needle foot extends in a straight line radially with respect to the longitudinal axis of the needle in transverse direction and is arranged transversely with respect to the longitudinal axis of the needle. Consequently, this holding means of the needle foot extends away from the longitudinal axis. The length of the holding means extends along a longitudinal central axis of the holding means of the needle foot, preferably on both sides of the longitudinal axis of the needle. The longitudinal axis of the holding means of the needle foot defines a transverse direction. The longitudinal axis of the holding means of the needle foot or the two legs and the longitudinal axis of the needle are preferably arranged at a right angle relative to each other. In special application situations, the angle between the longitudinal axes of the legs or the longitudinal axis of the holding means, on the one hand, and the longitudinal axis of the needle, on the other hand, may slightly deviate from a right angle, namely, by 1 to 2 degrees. The width of the holding means of the needle foot is measured in transverse direction—in the direction of the normal line—of the longitudinal central axis of the holding means of the needle foot. This normal line defines a width direction.

Due to the holding means that is arranged symmetrically with respect to an imagined plane, said plane extending in the direction of the width direction and along the longitudinal axis of the needle, it is possible to achieve an application of force of the needle bar of a textile machine in alignment with the longitudinal axis of the needle. In addition, there is the possibility of providing a linear or planar contact—extending, in particular, along the entire holding means—between the needle, in particular its needle foot, and the needle bar in order to avoid damage to the needle due to too small a contact site. In addition, the holding means can be manufactured in a simple non-cutting manner by pulling, pushing or pressure-type reshaping, so that materials that can only be bent with difficulty can be used in the manufacture of the needle.

Advantageous embodiments of the needle result from the dependent patent claims.

The holding means of the needle foot and the upper shank section of the needle may form a T-shaped holding region of the needle that is disposed to support the needle in a needle holder. However, preferably, the holding means may also be symmetrical relative to an imagined plane of symmetry that spreads along the longitudinal direction of the needle and in a direction transverse to the longitudinal direction of the holding means into a so-called width direction. Considering this embodiment, the needles may be arranged in a particularly space-saving manner in the needle holder of a textile machine. An application of force to the longitudinal axis of the needle is thus ensured.

Considering an advantageous embodiment, the holding means of the needle foot has, on its side facing away from the upper shank section, a support site on both legs, said support site being provided, in particular in transverse direction, along the entire length of the holding means. In so doing, the support site may be configured as a support surface having a surface normal pointing in the direction of the longitudinal axis of the needle. As a result of this, it is possible to create a particularly large-area gentle contact between the holding means of the needle foot and the needle bar of a needle holder.

If the mean value of the width of the holding means of the needle foot in the width direction, or at least the width of the holding means at the transition site to the upper shank section, is smaller than the diameter of the upper shank section, it becomes possible to increase the needle density when the needles are arranged in a needle board of a needle holder. The grooves provided on an upper side of the needle board, in which grooves—in operative position of the needles—their holding means of the needle foot are located, may have a smaller width matching the holding means, so that more grooves may be provided on the needle board.

In a preferred exemplary embodiment, the cross-section of the holding means of the needle foot has a cross-sectional form that deviates from the circular contour. For example, it may be oval, ellipsis-like, polygonal and, in particular, rectangular or hexagonal or triangle-like. For example, corner regions or edge regions of the holding means may have a radius or be arcuate, so that a corner-less or edge-less lateral surface is attained on the holding means. In order to achieve the desired cross-sectional form, the holding means may be shaped from a needle blank by a non-cutting manufacturing technique, for example, be reshaped by pulling, pushing or pressure. In a simple manner, it is also possible to shape the holding means of materials that can be vent only with great difficulty.

Considering another preferred embodiment of the needle, the cross-section of the upper shank section may have a cross-sectional form that deviates from a circular contour. In so doing, it is advantageous if the area of the cross-section of the upper shank section corresponds substantially to the area of the cross-section of the lower shank section. Then, it is possible to simply make the upper shank section of a blank having the diameter of the lower shank section. At the same time, it is possible to enlarge the diameter of the upper shank section relative to the diameter of the lower shank section.

Additional details of the embodiments of the invention are obvious from the description, the drawings or the claims. The description is restricted to essential details of the embodiments of the invention and other situations. The drawings disclose additional details and are to be referred to as being supplementary.

DETAILED DESCRIPTION OF THE INVENTION

Figure 1:
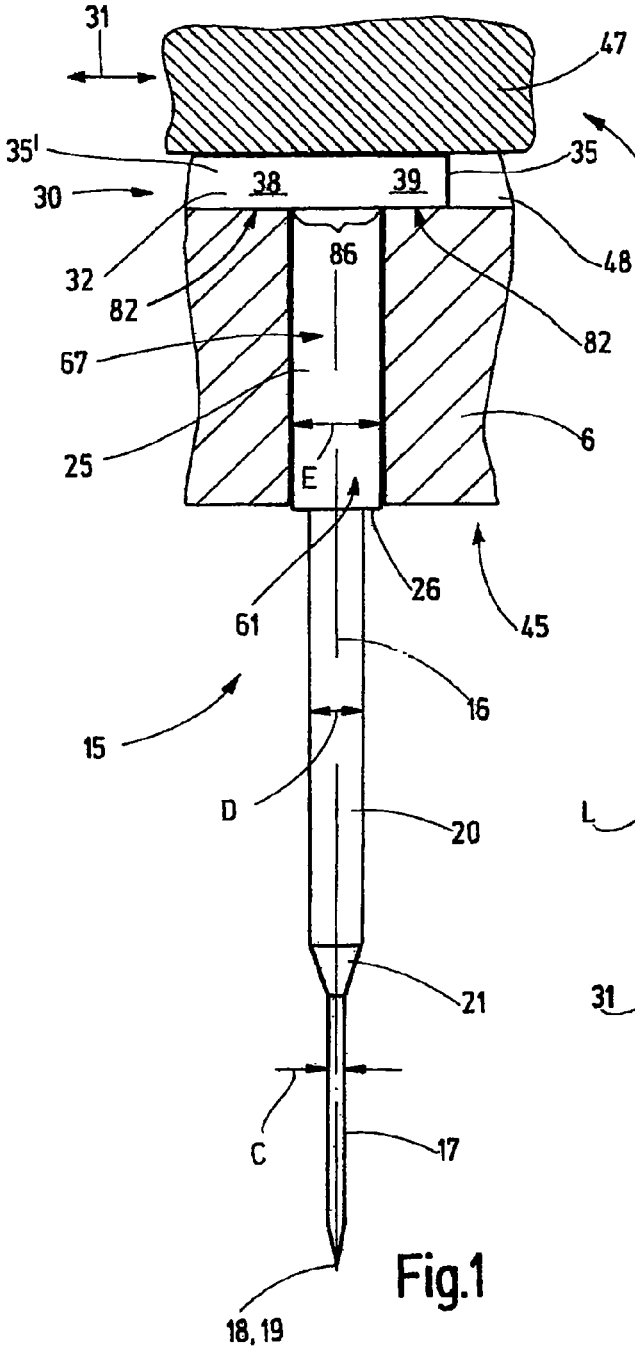
FIG. 1 is a schematic side view of an exemplary embodiment of a needle set in a needle holder, wherein the needle holder is shown, partially in section.
Figure 2:
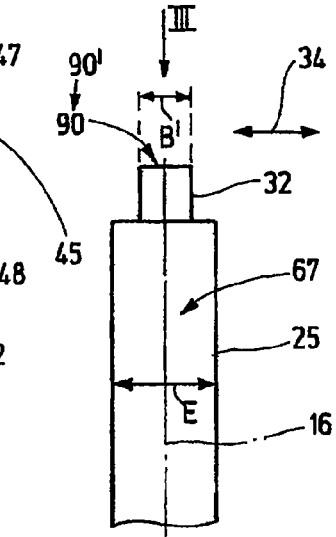
FIG. 2 is a front view of the upper shank section and the holding means of the needle foot of the needle.
Figure 3:
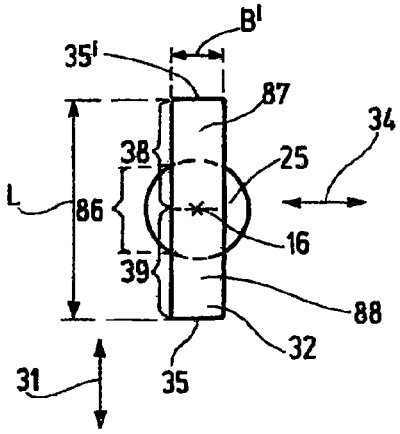
FIG. 3 is a plan view of the needle of FIGS. 1 and 2, following arrow III along the longitudinal axis of the needle.

FIG. 1 is a schematic illustration of a needle 15.

The needle 15 has a working section 17 extending along a longitudinal axis 18, whereby a needle point 18 is provided on said working section. The needle point 18 represents the first free end 19 of the needle 15.

Adjoining the working section 17, is a lower shank section 20 that extends coaxially with respect to the longitudinal axis 16 and coaxially with respect to the working section 17. The lower shank section 20 has a circular cross-section with a diameter D that is greater than the diameter C of the working section 17. The diameter of a shank section 20 or the working section 17 of the needle 15 corresponds to the smallest-possible diameter of a lateral cylinder surface of a circular cylinder, said lateral cylinder surface extending coaxially with respect to the longitudinal axis 16 and completely circumscribing the respective shank section. In so doing, no parts of the respective section extend through the lateral cylinder surface. Due to the different diameters of the working section 17 and of the lower shank section 20, these two sections 17, 20 are connected to each other by means of a conical first transition region 21, said region widening continuously from the working section 17 toward the lower shank section 20.

The outside surface of the first transition region, in accordance with the example of the lateral cylinder surface, represents that of a truncated cone. Considering a modification thereof, the transition region 21 could also be made to be without edges. Furthermore, it is possible to provide reinforcement ribs on the first transition region 21 in order to increase the flexural stiffness of the needle in this region.

An upper shank section 25 adjoins the lower shank section 20 with the circular cross-section, the cross-section of said upper shank section—in the simplest case—being potentially also circular, as is schematically shown in FIGS. 1 through 5.

Considering the exemplary embodiment in accordance with FIG. 1, a first step 26 is provided between the lower shank section 20 and the upper shank section 25, said step having the configuration of an annular surface because the diameter E of the upper shank section 25 is greater than the diameter D of the lower shank section 20.

A needle foot 30 adjoins the upper shank section 25, said needle foot having a holding means 32 that essentially extend in a straight line. This holding means 32 extends along a transverse direction 31 that is transverse to the longitudinal axis 16 of the needle 15.

The holding means 32 comprises two legs 38, 39 that extend from the longitudinal axis 16 away from each other. The holding means 32 consists of one piece so that the two legs 38, 39 smoothly adjoin each other without seams, commissures, and are without transition. In transverse direction 31, the holding means 32 extends from a first free end 35 on one leg 39 to a second free end 35' on the other leg 38. The length L of the needle foot 30 and the holding means 32 between the two free ends 35, 35' is greater than the diameter of the upper shank section 25, thus forming, on the underside of the holding means 32 facing the upper shank section 25, an abutment site 82 on each of the two legs 38, 39.

In a width direction 34 (FIG. 2) transverse to the longitudinal axis 16 and transverse to the longitudinal direction of the needle foot 30, the holding means 32 has a width B' that, as a function of the cross-sectional form of the holding means 32, may be different in size at various points. Considering the exemplary embodiment of FIGS. 1 through 3, the cross-section of the holding means 32 is rectangular, so that the width is constant at various points along the longitudinal axis 16 of the needle 15. Considering other cross-sectional forms, the width B' may be different in size at various points of the holding means 32. In so doing, the mean value of the width B' of the holding means 32 is smaller than the diameter E of the upper shank section 25. Preferably, the width B' of the holding means 32 is smaller along each point of the length of the needle foot 30 than the diameter E of the upper shank section 25.

The cross-section of the holding means 32 may remain unchanged along its entire extension in transverse direction 31. Depending on the desired configuration of the form of the cross-section, however, it may be required to configure the cross-section in its central region 86 (FIG. 3) where the holding means 32 is connected to the upper shank section 25 in a different manner than at the two leg ends 87, 88 adjoining the central region 86. Abutment sites 82 are provided on these leg ends 87, 88. The lengths of the leg ends 87, 88 are preferably equal to the lengths of the abutment sites 82 and smaller than the lengths of the legs 38, 39.

On its upper side opposite the abutment sites 82, the holding means 32 has a support site 90, said support site being provided on both legs 38, 39 and preferably extending in transverse direction 31 along the entire holding means 32.

Considering the preferred modification of the embodiment, the support site 90 is configured planar as the support surface 90' and extends over the entire length of the legs 38, 39. The support surface 90' thus comprises the entire length of the needle foot 30 and/or the holding means 32.

The holding means 32 is configured so as to be symmetrical with respect to an imagined plane of symmetry, said plane widening along the longitudinal axis 16 and in the width direction 34. Originating from this plane of symmetry, the two legs 38, 39 of the holding means 32 extend away from each other in opposite directions.

FIGS. 4*a* through 4*f* show various possible cross-sectional forms of the holding means 32 of the needle foot 30. The configuration of the cross-section of the leg ends 38, 39 or of the entire holding means 32 differ, in particular, in that the support site 90 either has the configuration of a more linear or, alternatively, a planar form of a support surface 90'. The same applies to the abutment sites 82 that are provided on the leg ends 38, 39, said abutment sites also being potentially either linear or, alternatively, having the form of a planar abutment surface 82'. In accordance with FIG. 4*a*, an ellipse-like cross-sectional form is provided, whereby—in the region of the ancillary vertices of the elliptical contour—flat regions are provided, so that, on the one hand, a planar support surface 90' is being formed and, on the other hand, a planar abutment surface 82'. The main axis of the elliptical contour extends in width direction 34. The cross-section suggested in FIG. 4*f* corresponds to the embodiment as in FIG. 4*a*; however, it is rotated by 90 degrees, so that the main axis of the elliptical contour of the cross-section extends in the direction of the longitudinal axis 16. Thus, in the region of the two main vertices of the elliptical cross-sectional form, the support site 90 is provided on the one hand, and the abutment site 82 is provided on the other hand.

Figure 4A:
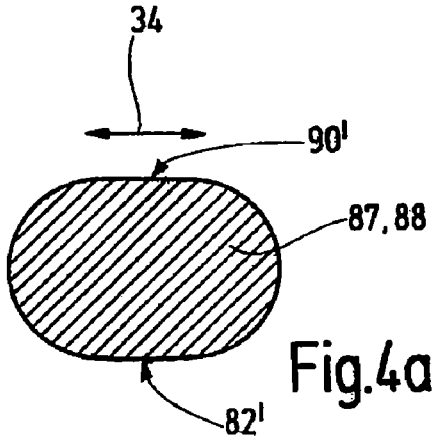
FIGS. 4*a* through 4*f* are various cross-sectional forms of the holding means of the needle foot.
Figure 4B:
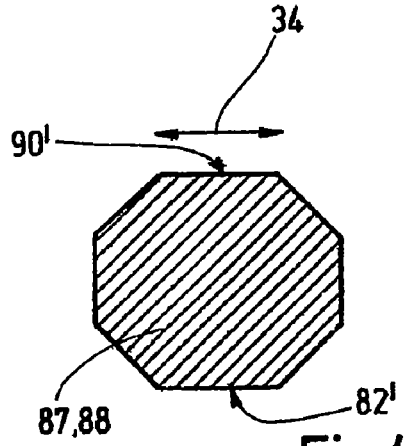
Figure 4C:
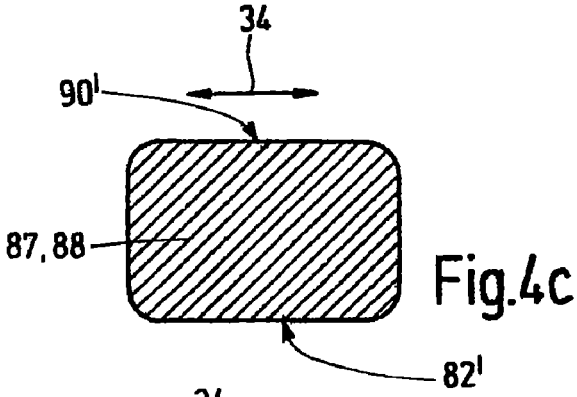
Figure 4D:
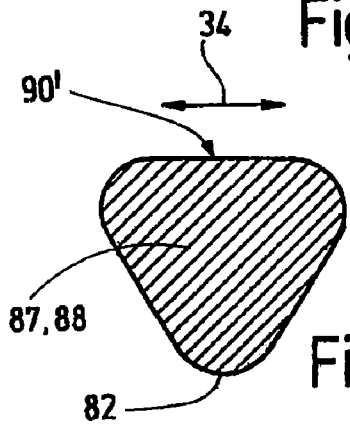
Figure 4E:
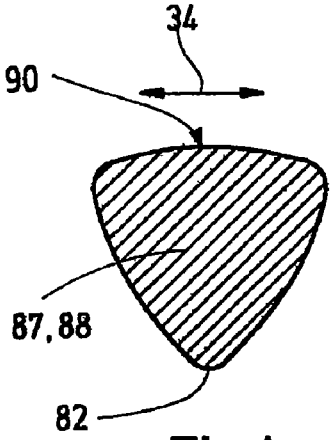
Figure 4F:
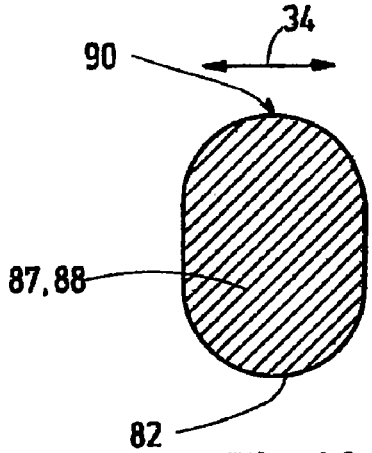

The mean value of the width and, in particular, the width of the holding means 32, is smaller at any point in width direction 34 than the diameter E of the upper shank section 25. The cross-section of the holding means 32 may be oval (having the shape of a race-track) or elliptical. Considering the exemplary embodiment in accordance with FIG. 4*b*, the cross-section of the holding means 32 is polygonal and, for example, represents a regular octagon. The corners of such a polygon may also be rounded, for example have a radius as is shown, for example, with reference to a rectangle in FIG. 4*c*. Considering the two exemplary embodiments in accordance with FIGS. 4*d* and 4*e*, the cross-section of the holding means 32 has a triangular form. As in FIG. 4*c*, the corner regions of the triangle-like cross-sectional configuration in accordance with FIG. 4*d* are provided with radii. The radii in the corner regions of the cross-section in accordance with FIG. 4*e* are distinctly smaller than in the case of the modification of the embodiment shown in FIG. 4*d*. Different from FIG. 4*d*, the sides of the triangle in the triangular cross-section in accordance with FIG. 4*e* protrude outward.

On the side opposite of the lower shank section 20 opposite the first step 26 and the working section 17, there is an adjoining upper shank section 25. The upper shank section 25, as well as the lower shank section 20 and the working section 17, are arranged coaxially with respect to the longitudinal axis 16. Considering the modification of the embodiment in accordance with FIGS. 1 through 3, the cross-section of the upper shank section 25 is circular. A potential modification thereof may provide for any other cross-sectional form, whereby a few cross-sectional forms of the upper shank section 25 are illustrated as examples in FIGS. 5*a* through 5*f*. The contour of the cross-section may be polygonal, for example, square, oval (form of a race-track), or like an ellipse, cruciform or triangle-like. The upper shank section 25 may be configured in a twisted form like a spiral. Radii or bulges may be provided in the regions of the edges or corners in order to achieve surface transitions without edges on the outside surface 67 of the upper shank section 25.

Regularly distributed over the circumference on the upper shank section 25 are abutment sites 60 that are located on a common lateral cylinder surface 61 about the longitudinal axis 16 of the needle 15. The number of abutment sites 60 that are provided is a function of the cross-sectional form of the upper shank section 25. If the abutment sites 60 are located over a larger surface area of the lateral cylinder surface 61, two opposing abutment sites 60 may be sufficient. Preferably, three, four or also more abutment sites 60 are distributed on the circumference in a regular manner on the outside surface 67 of the upper shank section 25.

Outside the abutment sites 60, the upper shank section 25 does not have any region that projects radially with respect to the longitudinal axis 16 beyond the common lateral cylinder surface 61 of the abutment sites 60. Consequently, outside the abutment sites 60, the outside surface 67 of the upper shank section 25 is inside the lateral cylinder surface 61. If the shank section 25 is twisted in the form of a spiral (not illustrated), the abutment sites 60 follow this spiral on the lateral cylinder surface 61. An upper shank section 25 that is twisted in the form of a spiral may be formed with any cross-sectional contour by twisting the upper shank section 25 about the longitudinal axis 16.

Figure 5A:
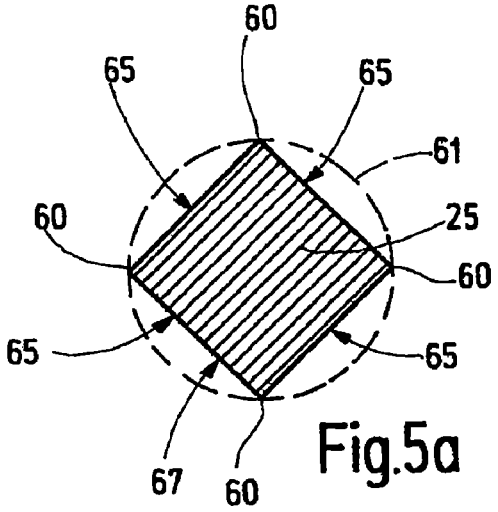
FIGS. 5*a* through 5*f* are various cross-sectional forms of the upper shaft shank.

The upper shank section 25 may have, for example, a polygonal, in particular rectangular or, as shown in FIG. 5*a*, a square cross-section. Each corner of the polygon has the same distance from the longitudinal axis 16 of the needle, so that longitudinal edges extending along the upper shank section 25 in longitudinal direction along the longitudinal axis 16 form longitudinal abutment sites 60.

Figure 5B:
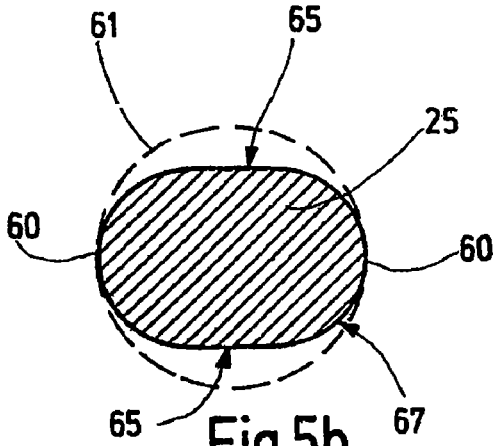

FIG. 5*b* shows an oval (form of a race-track) or an ellipse-like cross-sectional form of the upper shank section 25. The abutment sites 60 are provided in the region of the main vertices. In the region of the ancillary vertices, the oval or ellipse is flattened, so that the upper shank section 25 has plane outside surface sections 67 on two opposing sides in the region of the ancillary vertices, said outside surface sections representing the recesses 65 between the two abutment sites 60.

Figure 5C:
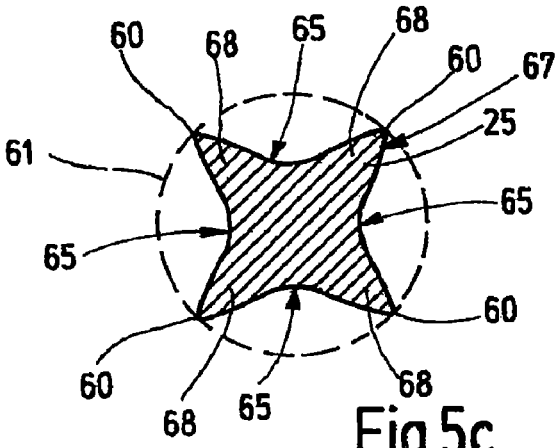
Figure 5D:
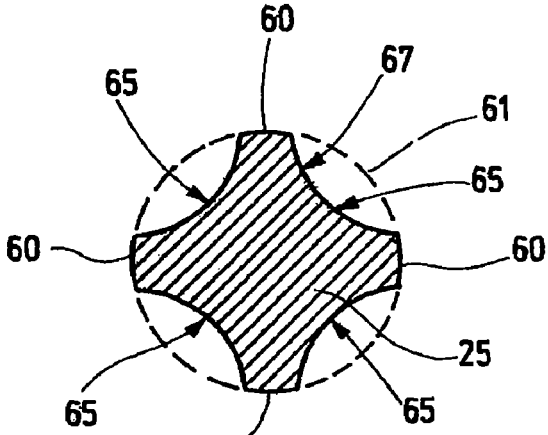

Alternatively, the cross-section of the upper shank section 25 may also have the contour of a star or a cross, as is obvious, for example, from FIGS. 5*c* and 5*d*. The star-like cross-sectional contour has several star points 68, whereby the abutment sites 60 are formed on their radially outermost ends. The recesses 65 are provided between two adjacent star points 68. Considering the exemplary embodiment in accordance with FIG. 5*c*, the star-shaped cross-sectional contour of the upper shank section 25 comprises star points 68 that are uniformly distributed over the circumference, said points extending outward from a central region about the longitudinal axis 16 and, in so doing, tapering toward their radially outermost end. At this radially outermost end, the star points 68 are rounded, so that, preferably, no sharp edges are formed on the abutment sites 60. The outside surface section 67 of the recess 65 is curved concavely inward in a V-like manner. The transition between the star points 68 is without edge. By modifying the illustrated embodiment, it is also possible to provide more than four star points 68.

Considering the cruciform cross-section of FIG. 5*d*, the abutment sites 60 are curved convexly outward in radial direction, whereby the curvature has, in particular, the same radius as the lateral cylinder surface 61. The recesses 65 between the abutment sites 60 are formed by the concavely curved outside surface sections 67 of the upper shank section 25, said outside surface sections displaying an arcuate shape viewed in cross-section of the upper shank section 25.

Figure 5E:
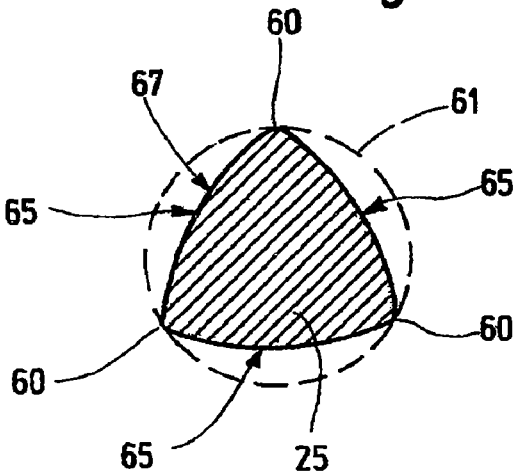
Figure 5F:
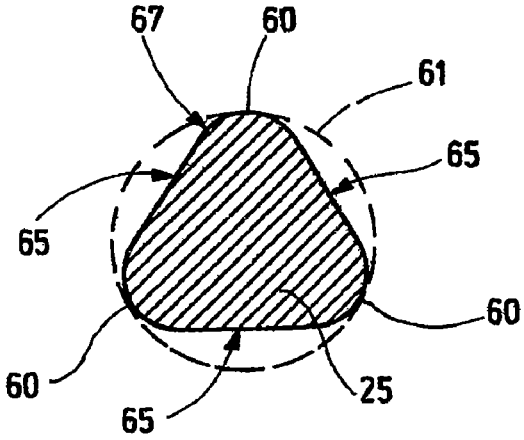

The two cross-sectional forms in accordance with FIGS. 5*e* and 5*f* provide a triangle-like cross-sectional form for the upper shank section 25. In the exemplary embodiment in accordance with FIG. 5*e*, the three outside surface sections 67 of the upper shank section 25 are convexly curved outward. The points of the triangle are also provided with a radius, so that the entire outside surface of the upper shank section 25 is configured without sharp edges and corners. The points represent the abutment sites 60 and are located on the common lateral cylinder surface 61. The curved outside surface sections 67 between the abutment sites 60 represent the recesses 65.

Figure 6:
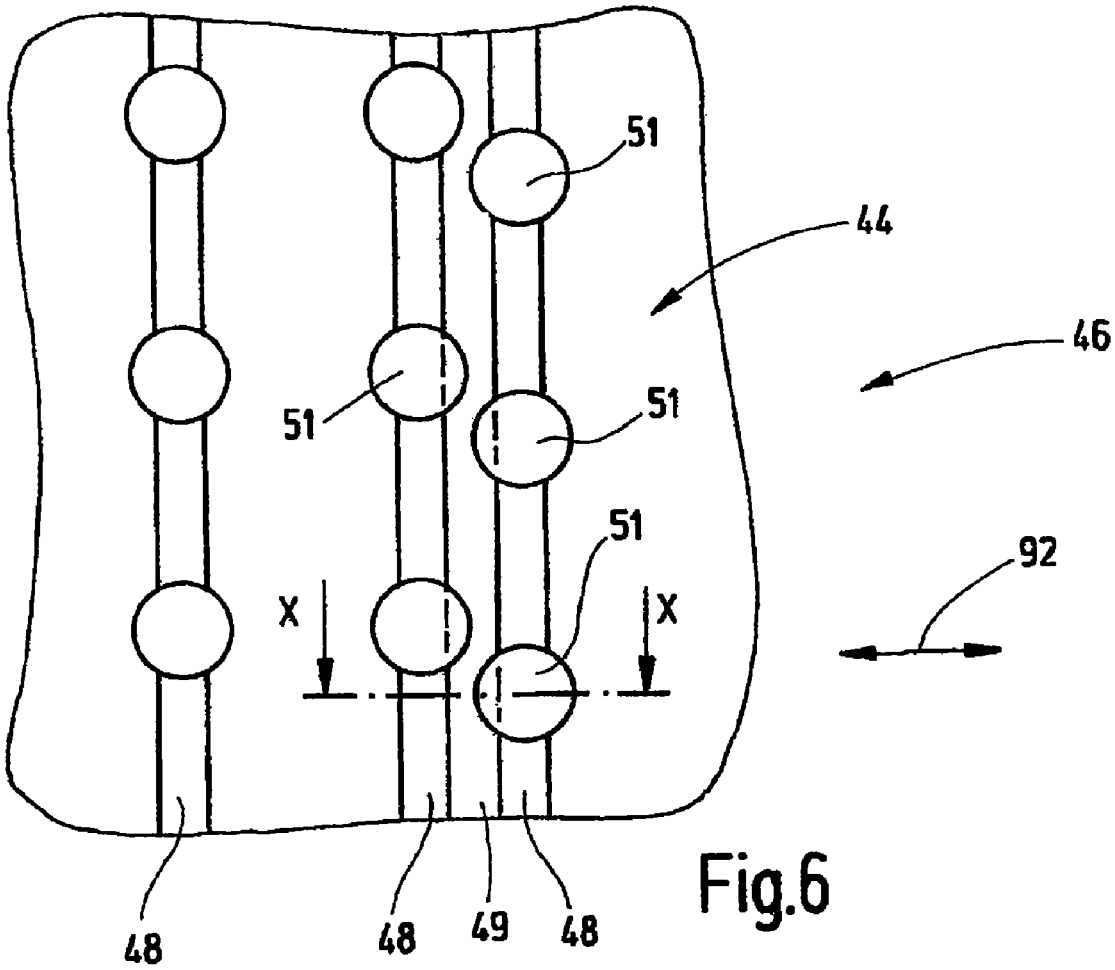
FIG. 6 is a plan view of a section of a needle board of a needle holder, looking at the upper side of the needle board.

Considering the triangle-like cross-sectional form shown in FIG. 5*f*, the recesses 65 are represented by three plane outside surface sections 67 of the upper shank section 25, said outside surface sections being distributed over the circumference in a regular manner. Viewed in circumferential direction, the abutment sites 60 are provided between these plane outside surfaces, said abutment surfaces being curved outward, for example, with a radius. The radius of the abutment sites 60 has a maximum size that is as large as the radius of the lateral cylinder surface 61 and—in the preferred exemplary embodiment according to FIG. 6*f*—is smaller than the radius of the common lateral cylinder surface 61.

The described exemplary embodiments of the cross-sectional form of the upper shank section 25 may deviate from the preferred embodiments shown in FIGS. 5*a* through 5*f*. For example, the corners and edges of a polygonal cross-section may be curved or provided with radii, so that an external outside surface of the upper shank section 25 without corners and edges is achieved. In all exemplary embodiments, the symmetry of the cross-sectional form of the upper shank section 25 is selected in such a manner that the center of gravity of the upper shank section 25 is located on the longitudinal axis 16.

The diameter of a shank section 20, 25 or of the working section 17 of the needle 15 is defined as the smallest-possible diameter of a lateral cylinder surface 61 of a circular cylinder arranged coaxially with respect to the longitudinal axis 16 of the needle, whereby the lateral cylinder surface 61 completely circumscribes the respective section. In so doing, none of the parts of the circumscribed sections 17, 20, 25 extend through the lateral cylinder surface 61.

The diameter E of the upper shank section 25 corresponds to the diameter of the lateral cylinder surface 61. In accordance with the example, the diameter E of the upper shank section 25 is greater than the diameter D of the lower shank section 20. Therefore, an annular surface 26 is formed in the transition region between the two shank sections 20, 25, said annular surface extending coaxially with respect to the longitudinal axis 16 of the needle 15. The areas of the cross-sectional surfaces of the upper and lower shank sections 20, 25 preferably have the same size but may also be slightly different.

The needle 15 is intended for the use in a textile machine, for example a felting machine. To accomplish this, the needle 15 is inserted in a needle holder 45 of the textile machine, said machine being shown schematically, partially in section, in FIG. 1.

In the description hereinafter it is assumed, for example, that needle board is arranged above the planar textile material that is to be processed. Basically, such a needle board may, additionally or alternatively, also be arranged below the planar textile material.

The needle holder 45 comprises a needle board 46 and a needle bar 47. Grooves 48 are provided in the needle board 46, said grooves being open toward an upper side 44 and extending—parallel to each other—at a distance from each other in one direction. The grooves 48 have oppositely arranged groove flanks 55 adjacent to the grooves' open side, said flanks delimiting the groove 48 in groove width direction 92, said width direction corresponding to the width direction 34 of the needle 15 with the needle inserted in the needle board 46. The two groove flanks 55 are connected to each other via a groove base 70.

Two adjacent grooves 48 are separated by a distance in the form of a strip 49. A plurality of bores 51 extend from the upper side 44 to an opposite underside 50 through the needle board 46. In the region of the upper side 44, the bores 51 terminate in the grooves 48. The central axis 52 of the bores extends—approximately centered—through the respective groove 48 in groove width direction 92. Several bores 51 are provided along each groove 48.

In this case, the needle holder 45 is provided for a not specifically illustrated felting machine. In so doing, the needle board 46 is arranged essentially in a horizontal manner. A needle 15 is inserted through each bore 51, so that the upper shank section 25 abuts with its abutment sites 60 against the inside surface of the respective bore 51, said bore representing a counter abutment surface 56 for the abutment sites 60. As a result of this, the needle 15 is arranged so as to be supported radially with respect to its longitudinal axis 16 in the needle board 46. Inasmuch as the working sections 17 of the needles need not always be configured symmetrically with respect to the longitudinal axis 16, a desired rotational position about the longitudinal axis 16 is accomplished, said position to be taken by the needles in the needle holder 45. In order to prespecify this rotational position and to also maintain it during the felting operation, the holding means 32 of the needle foot 30 of the needles 15 is arranged in the groove 48, said groove extending—in the region of the upper side 44—through the bore 51 in which the respective needle 15 is located. In so doing, the groove flanks 55 of the groove 48 act, as it were, as a rotating abutment for the holding means 32, so that the needle 15 is not able to rotate about its longitudinal axis 16 or is able to only rotate, corresponding to the play between the holding means 32 and the groove flanks 55, about its longitudinal axis 16. Preferably, the holding means 32—viewed in operative position of the needle 15 in width direction 34—is arranged without play in the groove 48.

The abutment sites 82 or abutment surfaces 82' on the two leg ends 87, 88 of the legs 38, 39 of the holding means 32 abut against the groove base 70. The two leg ends 87, 88 project beyond the bore 51 on the opposite sides into the groove 48.

During the felting process, the working direction is aligned parallel to the longitudinal axis 16 of the needles 15. The needle bar 46 is placed on the upper side 44 of the needle board 46, so that the needles 15—in working direction—are fixated parallel to the longitudinal axis 16, as can be schematically seen in FIGS. 1 and 2. During the felting process, the needle holder 45 with the needles 15 held in it moves up and down in working direction and processes the textile material that is arranged on a not specifically illustrated support.

A needle 15 of the needle board 46 may be arranged in each bore 51. In order to fixate the needles 15 in the direction of the longitudinal axis 16 that corresponds to the working direction, the needle bar 47 is in contact with the support site 90 or the support surface 90' of the holding means 32.

Figure 7:
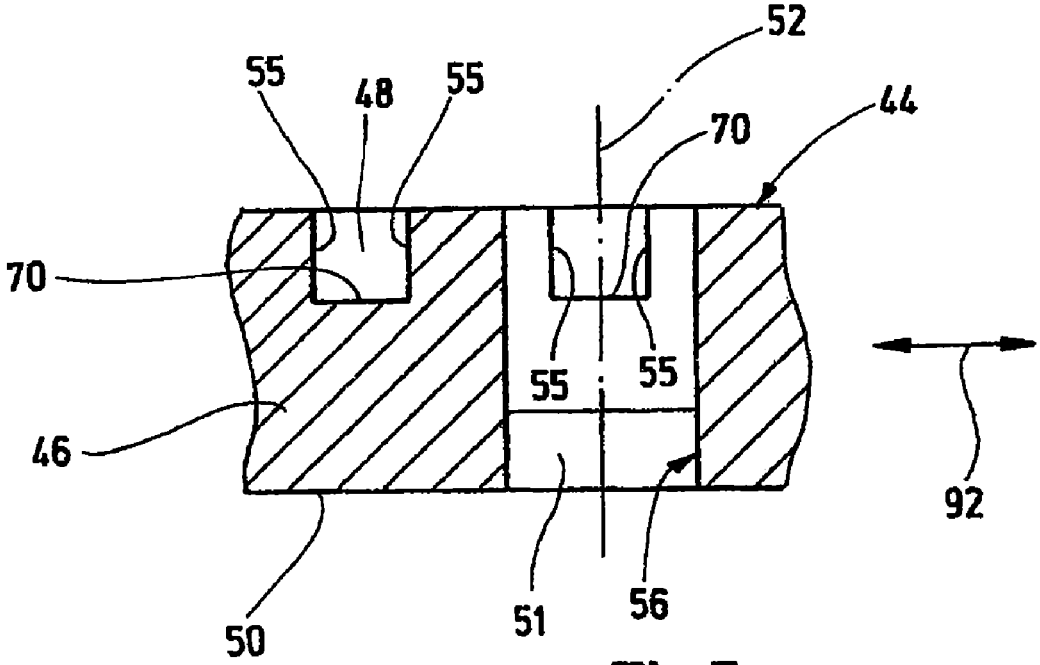
FIG. 7 is a cross-section along line X-X of a partial illustration of the needle board of FIG. 6.

The cross-section of the grooves 48 of the needle board 46 may have a form that is different from the rectangular form shown in FIG. 7, so that an adaptation of the groove cross-section to the cross-section of the holding means 32 or the leg ends 87, 88 is possible. To this extend, the groove 48 may have any cross-sectional form that also corresponds to the cross-sectional form of the holding means 32 or its leg ends 87, 88. In so doing, an exact adaptation of the cross-section of the grooves 48 to the cross-section of the leg ends 87, 88 extending into the groove 48 is not required, because the support of the holding means 32 in the groove 48 is only disposed to prevent a twisting of the needle 15 and to prespecify the desired rotational position of the needle 15 at the time of insertion into the needle board 46.

FIGS. 8*a* through 8*f* show different possible cross-sectional forms of the grooves 48.

Considering all the cross-sectional forms of the groove 48, the groove width B in the transition region between the groove flanks 55 and the groove base 70 is smaller than the diameter of the bore 51. Also, the mean value of the groove width B, which may change as a function of the viewed site on the groove flanks 55 or the groove base 70, is smaller than the diameter of the bore 51. In so doing, the groove width B may—at any point—be smaller than the diameter of the bore 51, as is the case with the groove diameters in accordance with FIGS. 8*a*, 8*b*, 8*d* and 8*f*. The mean value of the groove width B may be approximately half of the diameter of the bore 51.

Figure 8A:
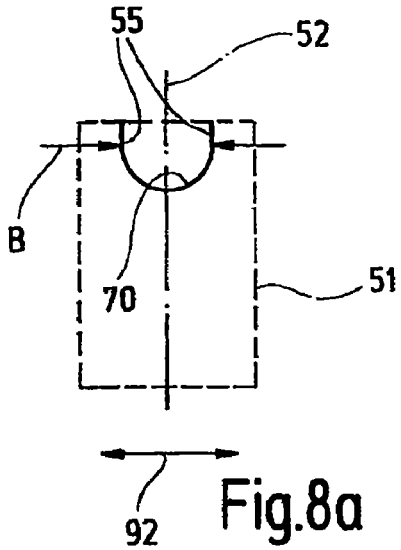
FIGS. 8*a* through 8*f* are various groove cross-sectional forms the grooves provided on the upper side of the needle board.

In FIG. 8*a* the cross-section of the groove is U-shaped with a channel-like groove base 70. A form, that is a modification thereof, is shown in FIG. 8*f*, where the groove base 70 consists of two surface sections 70*a*, 70*b*. Each of the two surface sections 70*a*, 70*b* is connected with one of the two groove flanks 55 and is inclined toward the central axis 52 by an angle of inclination of approximately 60 degrees, for example. In the center of the groove the two surface sections 70*a*, 70*b* abut against each other while forming an edge and subtend the double angle of inclination.

Figure 8B:
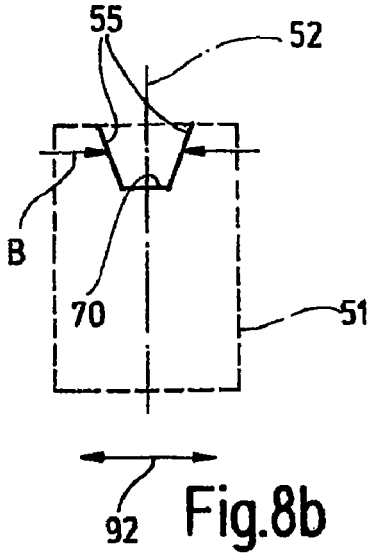
Figure 8C:
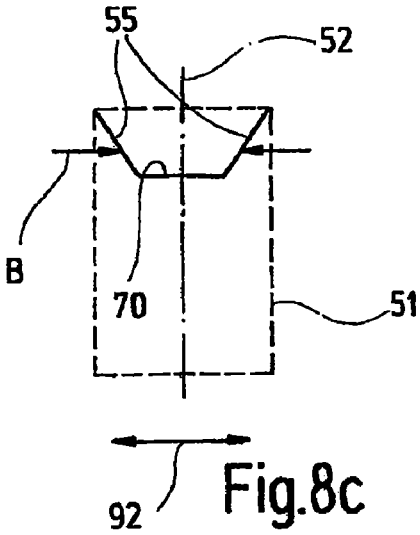

FIGS. 8*b* and 8*c* show another groove shape having a trapezoidal cross-section, whereby the groove base 70 extends transversely to the central axis 52 in width direction 34. The two groove flanks 55 are inclined relative to the central axis 52 of the bore 51. In accordance with FIG. 8*c*, the width B of the groove 48 on the upper side 44 of the needle board 46 corresponds to the diameter of the bore 51. Inasmuch as the two groove flanks 55, extending from the upper side 44 of the needle board 46, are arranged so as to be inclined in the direction of the central axis 52 of the bore 51, the mean width of the groove 48 is smaller than the diameter of the bore 51.

Figure 8D:
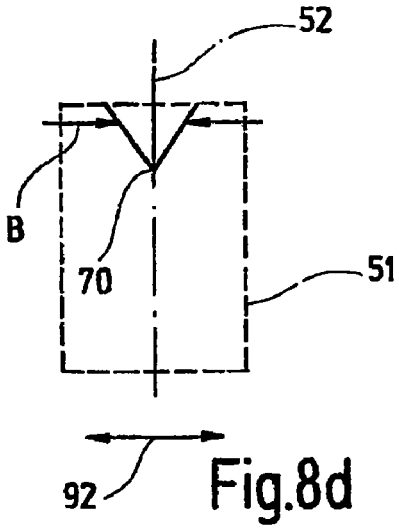
Figure 8E:
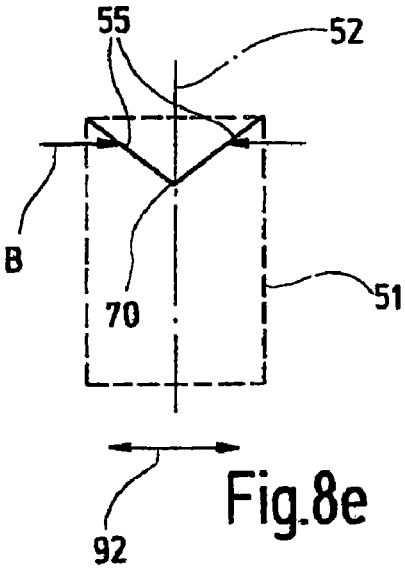
Figure 8F:
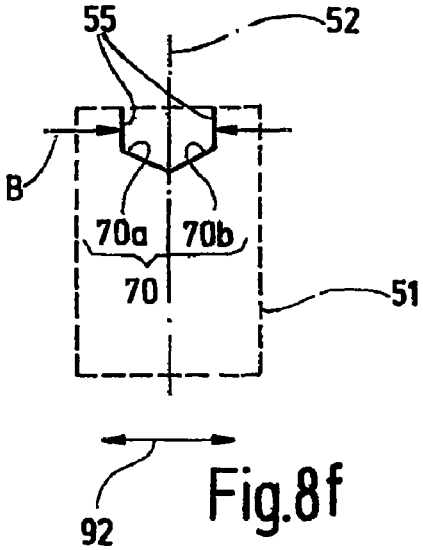

FIGS. 8*d* and 8*e* show triangular groove cross-sections, whereby the groove base 70 is formed by an edge in the transition region of the two groove flanks 55, said edge extending in the direction of the extension of the groove 48. The groove flanks 55 are arranged in a V-shape relative to each other and form an acute angle.

The needle 15 may be manufactured from a needle blank in a very simple manner, for example a wire pin. The diameter of the needle blank may correspond to the diameter D of the lower shank section 20, so that the needle blank may remain unchanged in this section. The upper shank section 25 and/or the needle foot 30 are shaped by a non-cutting manufacturing technique such as, e.g., by reshaping by pulling, pushing or pressure, in particular, by extrusion. The needle 15—overall and, in particular, also its working section 17, its lower and upper shank sections 20, 25, as well as its foot part 30, each viewed by itself—is made continuously of one piece of a uniform material without commissures. This represents a simple and cost-effective possibility of reshaping the needle blank in the region of the upper shaft section 25 and in the region of the needle foot 30 and to impart it with a desired cross-sectional form. During this reshaping process, the area of the cross-section of the upper shank section 25 remains preferably unchanged, so that it corresponds to the area of the lower shank section 20.

The invention relates to a needle 15 for a textile machine, in particular, to a felting needle or a fork needle. A working section 17 extends along a longitudinal axis 16 and has a needle point 18. Adjoining the working section 17 are a lower shank section 20 and an upper shank section 25, both being arranged so as to extend coaxially relative to each other along the longitudinal axis 16. Adjoining the upper shank section 25, a needle foot 30 is provided, said needle foot comprising a holding means 32. The holding means 32 extends in a transverse direction 31 and comprises two legs 38, 39, said legs extending from the longitudinal axis 16 and away from each other.

It will be appreciated that the above description of the present invention is susceptible to various modifications, changes and modifications, and the same are intended to be comprehended within the meaning and range of equivalents of the appended claims.

LIST OF REFERENCE NUMERALS

15 Needle
16 Longitudinal axis
17 Working section
18 Needle point
19 First free end of 15
20 Lower shank section
21 First transition region
25 Upper shank section
26 First step, annular surface
30 Needle foot
31 Transverse direction
32 Holding means
34 Width direction
35 Free end at 39
35' Free end at 38
38 Leg of 32
39 Leg of 32
41 Second transition region
44 Upper side of 46
45 Needle holder
46 Needle board
47 Needle bar
48 Groove
49 Strip
50 Underside of 46
51 Bore
52 Central axis of 51
55 Groove flank
56 Counter abutment surface
60 Abutment site
61 Lateral cylinder surface
65 Recess
67 Outside surface sections
68 Star point
70 Groove base
70*a* Surface section of 70
70*b* Surface section of 70
82 Abutment site
82' Abutment surface

86 Central region of 32
87 Leg end of 38
88 Leg end of 39
90, 90' Support site
92 Groove width direction
B' Width of 32
B Groove width
C Diameter of 17
D Diameter of 20
E Diameter of 25
L Length of 32

What is claimed is:

1. Needle for a textile machine comprising:

a working section comprising a needle point, said working section extending along a longitudinal axis, a lower shank section adjoining the working section, with an upper shank section adjoining said lower shank section, whereby the two shank sections extend coaxially with respect to each other along the longitudinal axis, and a needle foot adjoining the upper shank section and comprising a holding means, wherein the holding means extends in a transverse direction transversely with respect to the longitudinal axis and, comprises, originating from the longitudinal axis, two legs extending away from each other, and wherein the width of the holding means is smaller at each point along the legs than the diameter of the upper shank section in the width direction.

2. Needle in accordance with claim 1, wherein the holding means is symmetrical with respect to an imagined plane of symmetry, whereby the plane of symmetry extends along the longitudinal axis and transversely to the transverse direction in width direction.

3. Needle in accordance with claim 1, wherein the holding means has a support site on both legs on its side facing away from the upper shank section, said support site being formed along the entire holding means.

4. Needle in accordance with claim 1, wherein the lower shank section and/or the upper shank section and/or the holding means of the needle foot each have an unchanged cross-section over their entire extension.

5. Needle in accordance with claim 1, wherein the lower shank section and/or the upper shank section have a circular cross-section.

6. Needle in accordance with claim 1, wherein the cross-section of the holding means has a cross-sectional form deviating from a circular contour.

7. Needle in accordance with claim 1, wherein the cross-section of the holding means has an oval or ellipse-like form.

8. Needle in accordance with claim 1, wherein the cross-section of the holding means has a polygonal form.

9. Needle in accordance with claim 1, wherein the cross-section of the holding means has a triangle-like form.

10. Needle in accordance with claim 9, wherein the corners and/or edges of the cross-sectional form of the holding means are curved.

11. Needle in accordance with claim 1, wherein the cross-section of the upper shank section has a cross-sectional form deviating from a circular contour.

12. Needle in accordance with claim 1, wherein the area of the cross-section of the upper shank section essentially corresponds to the area of the cross-section of the lower shank section.

13. Needle in accordance with claim 1, wherein the cross-section of the upper shank section has abutment sites that are distributed over the circumference of said upper shank section, said abutment sites being located on a common lateral cylinder surface about the longitudinal axis.

14. Needle in accordance with claim 13, wherein one or more abutment sites extend in the form of a spiral on the lateral cylinder surface, or in that several abutment sites are arranged on a spiral on the lateral cylinder surface.

15. Needle in accordance with claim 8, wherein the cross-section of the holding means has a rectangular or hexagonal form.

16. A felting needle or a fork needle for a textile machine comprising:

a working section comprising a needle point, said working section extending along a longitudinal axis, a lower shank section adjoining the working section, with an upper shank section adjoining said lower shank section, whereby the two shank sections, extend coaxially with respect to each other along the longitudinal axis, and a needle foot adjoining the upper shank section and comprising a holding means, wherein the holding means extends in a transverse direction transversely with respect to the longitudinal axis and, comprises, originating from the longitudinal axis, two legs extending away from each other, and wherein the width of the holding means is smaller at each point along the legs than the diameter of the upper shank section in the width direction.

* * * * *